US005900596A

United States Patent [19]

Koshak et al.

[11] Patent Number: 5,900,596

[45] Date of Patent: May 4, 1999

[54] HYDRAULIC BRAKE CONTROLLER

[75] Inventors: John W. Koshak, Barrington Hills, Ill.; Paul L. Baldwin, Orrtanna, Pa.; Tony S. Huen, Piedmont, Calif.; James L. Murphy, Streamwood, Ill.

[73] Assignee: Inventio AG, Hergiswil NW, Switzerland

[21] Appl. No.: 08/832,327

[22] Filed: Mar. 26, 1997

Related U.S. Application Data

[63] Continuation-in-part of application No. 08/540,323, Oct. 6, 1995.

[51] Int. Cl.[6] ..... B66B 1/32

[52] U.S. Cl. ..... 187/288; 187/286; 187/285

[58] Field of Search ..... 187/289, 393, 187/286, 285, 287, 288; 188/67

[56] References Cited

U.S. PATENT DOCUMENTS

| | | | |
|---|---|---|---|
| 3,571,865 | 3/1971 | Johnson | 188/67 |
| 3,647,027 | 3/1972 | Jaseph | 187/272 |
| 3,783,976 | 1/1974 | Kerr | 91/41 |
| 3,783,983 | 1/1974 | McNally et al. | 188/188 |
| 3,942,607 | 3/1976 | Sobat | 187/77 |
| 3,995,534 | 12/1976 | Rastetter | 91/44 |
| 4,007,815 | 2/1977 | Acre | 188/67 X |
| 4,306,339 | 12/1981 | Ward | 188/67 |
| 4,378,059 | 3/1983 | Hatakeyama et al. | 187/393 |
| 4,449,615 | 5/1984 | Beath | 188/67 |
| 4,491,198 | 1/1985 | Noda et al. | 187/393 |
| 4,638,888 | 1/1987 | Coy | 187/19 |
| 4,715,456 | 12/1987 | Poe, Jr. et al. | 188/67 X |
| 4,823,919 | 4/1989 | Hayatdavoudi | 188/244 |
| 4,898,263 | 2/1990 | Manske et al. | 187/393 |
| 5,052,523 | 10/1991 | Ericson | 187/89 |

OTHER PUBLICATIONS

Article, "Innovation", *Elevator World*, pp. 50–52, Feb. 96.

*Primary Examiner*—Robert E. Nappi

*Attorney, Agent, or Firm*—MacMillan, Sobanski & Todd, LLC

[57] ABSTRACT

This invention includes a brake system for a hydraulic ram or another cylinder, that can be employed as an emergency brake for a lifting elevator. When actuated, the brake arms contact the ram circumferentially to slow and stop the falling ram. The brake arms are preferably lined with an able material that frictionally engages the ram to stop the downward motion of the ram. The brake system may be actuated by loss of hydraulic pressure, by an electronic signal from a hydraulic pressure detector, by down overspeed sensor or by an uncontrolled down motion detector. According to another aspect of the present invention, a controller, which is preferably a programmed control system, compares the actual motion of the elevator as sensed by a detector to a desired motion. Under certain conditions, if the actual motion differs from the desired motion, the controller actuates the brake.

24 Claims, 12 Drawing Sheets

98
102
134
132
PCB
TRANSFORMER
BATTERY
130
106
120
118
114
116
100
112
108
110
104
122
121
128
128
43
126
124
126
124
121
3
5

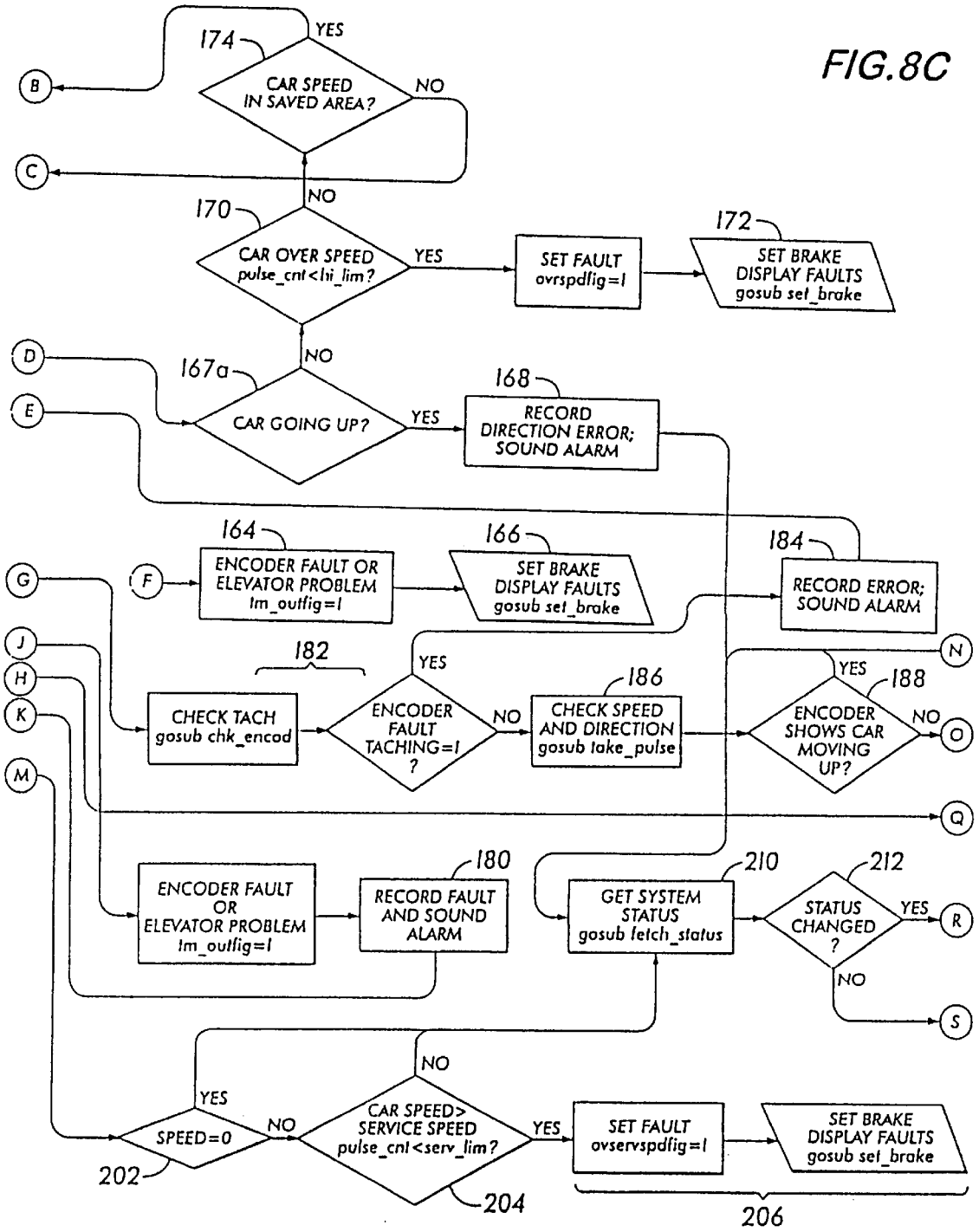
FIG.8C
174
CAR SPEED IN SAVED AREA?
YES
NO
B
C
170
CAR OVER SPEED pulse_cnt<lii_lim?
YES
NO
SET FAULT ovrspdflg=1
172
SET BRAKE DISPLAY FAULTS gosub set_brake
D
E
167a
CAR GOING UP?
YES
NO
168
RECORD DIRECTION ERROR; SOUND ALARM
164
ENCODER FAULT OR ELEVATOR PROBLEM lm_outflg=1
F
166
SET BRAKE DISPLAY FAULTS gosub set_brake
184
RECORD ERROR; SOUND ALARM
G
J
H
K
M
182
CHECK TACH gosub chk_encod
ENCODER FAULT TACHING=1 ?
YES
NO
186
CHECK SPEED AND DIRECTION gosub take_pulse
188
ENCODER SHOWS CAR MOVING UP?
YES
NO
N
O
Q
ENCODER FAULT OR ELEVATOR PROBLEM lm_outflg=1
180
RECORD FAULT AND SOUND ALARM
210
GET SYSTEM STATUS gosub fetch_status
212
STATUS CHANGED ?
YES
NO
R
S
SPEED=0
YES
NO
202
CAR SPEED> SERVICE SPEED pulse_cnt<serv_lim?
NO
YES
204
SET FAULT ovservspdflg=1
SET BRAKE DISPLAY FAULTS gosub set_brake
206

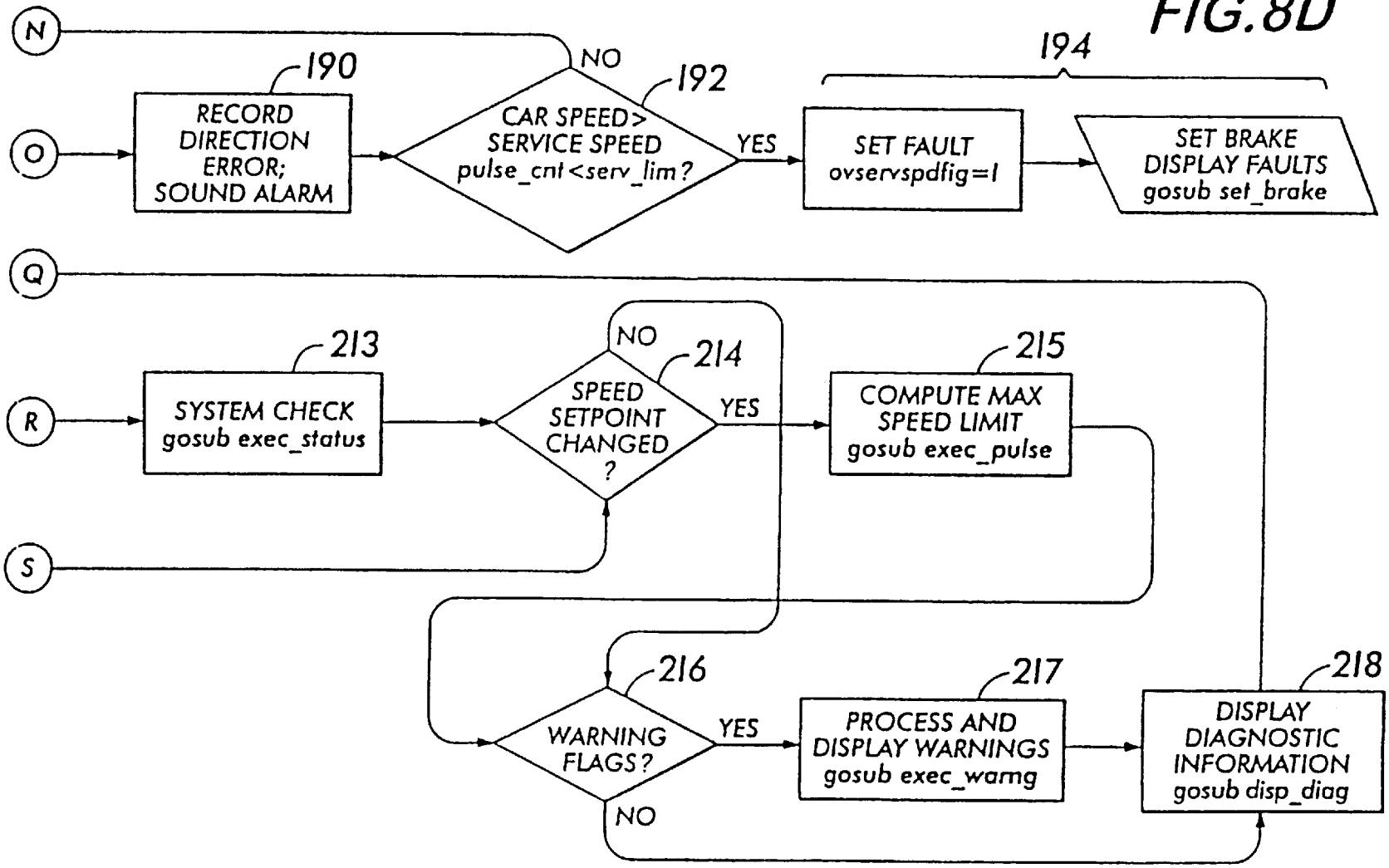
FIG. 8D
N
O
Q
R
S
190
RECORD DIRECTION ERROR; SOUND ALARM
192
CAR SPEED> SERVICE SPEED pulse_cnt<serv_lim?
NO
YES
194
SET FAULT ovservspdfig=1
SET BRAKE DISPLAY FAULTS gosub set_brake
213
SYSTEM CHECK gosub exec_status
214
SPEED SETPOINT CHANGED ?
NO
YES
215
COMPUTE MAX SPEED LIMIT gosub exec_pulse
216
WARNING FLAGS?
YES
NO
217
PROCESS AND DISPLAY WARNINGS gosub exec_warng
218
DISPLAY DIAGNOSTIC INFORMATION gosub disp_diag 98
102
134
PCB
132
TRANSFORMER
BATTERY
130
106
120
118
114
116
100
112
108
110
104
3
38
5

HYDRAULIC BRAKE CONTROLLER

CROSS REFERENCE TO RELATED APPLICATION

This application is a continuation-in-part of commonly assigned co-pending U.S. patent application Ser. No. 08/540,323, filed Oct. 6, 1995.

FIELD OF THE INVENTION

The present invention relates generally to safety brakes that stop movement of either a hydraulic jack, a plunger or a ram without permanently damaging or destroying it and a controller for such a safety brake.

BACKGROUND OF THE INVENTION

There have been numerous brake systems developed for stopping hydraulic ram elevators during emergency situations. All of the prior art patents found were directed toward collets that during a hydraulic pressure failure would drop down and wedge in between a fixed housing and the ram of the elevator. The friction generated by the downward motion of the ram in contact with the collet or brake shoe causes the collet or tapered brake shoe to be driven downward, thereby wedging the ram to a halt. Empirical evidence indicates that the force necessary to stop an elevator using a brake of this type exceeds the elastic limit of the material used to construct commercial rams. As a result, the ram may be deformed into an hourglass shape at the point where the brake grips the ram. Since this type of damage to the ram cannot be repaired, the ram and in some instances its associated components must be replaced in order to restore the elevator to working condition. Replacement of the ram is time consuming and expensive.

Because the elevator brakes disclosed in prior art patents have a relatively large number of moving parts, they are relatively complex. Additionally, the prior art devices are relatively large and bulky. In designing a brake system, size is an important consideration because there is often limited space into which to fit a braking device. Therefore, in order to facilitate installation of new brake systems into hydraulic elevators, it is desirable for them to have a low profile.

A specific example of a prior art design having the above mentioned shortcomings is Beath et al., U.S. Pat. No. 4,449,615, which discloses a floor mounted lever-actuated wedge device. The many components in this design complicate it by comparison to the present invention. Beath uses a collet design. During certain conditions, such as a hydraulic pressure failure, the collets will drop down and wedge in between a fixed housing and the ram of the elevator. The friction generated by the downward motion of the ram in contact with the collets causes the collets to be driven downward. As this occurs, the collets are wedged against the ram. The contact between the collets and ram generates a friction force which slows the ram and eventually becomes great enough to stop the descent of the ram. The force necessary to stop an elevator using the brake disclosed in Beath exceeds the elastic limit of the material used in commercial rams. As mentioned above, this causes the ram to deform into an hourglass shape at the point where the collets grip the ram. In regard to the importance of braking systems having a relatively low profile, the above mentioned patent does not precisely show the relation of the system to the top of the cylinder and the bottom of the elevator. However, it appears too tall to fit most existing elevator systems. In light of the problems discussed above and exemplified by U.S. Pat. No. 4,449,615, a new elevator brake is needed that can safely stop a fully loaded elevator without permanently damaging the ram. A control system for such a new elevator brake is also needed.

SUMMARY OF THE INVENTION

The general object of the present invention is to provide a mechanism for arresting an elevator which can safely stop a fully loaded elevator without permanently damaging any part of the elevator.

Another object of the present invention is to provide an elevator arrestor that allows the elevator to be usable within a short period of time with little reset and repair necessary. Optimally, the reset and repair procedure should be relatively simple and inexpensive.

A further object of the present invention is to provide an arrestor that will fit within a small vertical space such that it can fit within the normal design parameters for hydraulic ram elevators, and may also be retrofit into existing hydraulic ram elevators.

Yet another object of the present invention is to provide a system that can be easily installed and requires very little down time in which the elevator is non-functional.

An additional object of the present invention is to provide for an arresting system that is inexpensive to manufacture.

A still further object of this invention is to provide a controller and control algorithm for an arrestor or brake of the kind disclosed herein.

A presently preferred embodiment of the invention provides a hydraulic brake system for slowing and stopping a ram, jack or other cylinder type object. The preferred embodiment utilizes two lever acting brake arms. These brake arms are lined with a material that is softer than the material from which the ram or similar device is constructed. For example, the lining material may have a lower Brinell hardness number and/or a lower yield strength than the ram. The lining material is machined inside the brake arms to a diameter slightly less than the diameter of the ram. When actuated, the brake arms and their respective lining material contact the ram circumferentially, elastically squeeze the ram and thereby generate a frictional force as the ram is elastically deformed. Due to the forces generated from the friction and the elastic squeezing of the ram, it slows and eventually stops its downward motion. Because almost all, if not all, of the deformation of the ram is elastic, the ram is not substantially deformed during this process.

Because the present invention uses a material that is softer than the ram to apply a braking force, it is a clear improvement over the prior art. Preferably, this relatively soft material is copper and the ram is comprised of steel. The present invention is also relatively simple and low in profile. This facilitates installation in current elevator designs.

Preferably, the brake system also has buttress members, pivot pins and a base plate. The pivot pins connect the brake arms to the buttress members. Additionally, the brakes arms are also mounted to the base plate.

The brake arms may be actuated mechanically by loss of hydraulic pressure, an electronic signal from a hydraulic pressure detector, a downward overspeed detector or an uncontrolled downward motion detector. In preferred embodiments, the force applied by the braking action is transferred from the brake arms through the base plate and to its associated support structures. This structure can absorb the energy without damage or deformation and without any modifications. By monitoring the pressure and overspeed, the fall of the elevator can be limited to speeds with a maximum of less than twice the normal down speed, thus limiting the kinetic energy produced, by not allowing a free falling elevator.

In accordance with another aspect of the present invention, a system is provided to non-destructively capture a hydraulic plunger on elevators, and such a system preferably includes a unique controller to control its operation. Additionally, this system includes a detection system and an actuator. The detection system continuously senses the speed of the elevator and the direction of elevator movement. After detecting these parameters, the detection system generates an electrical signal corresponding to the detected speed and direction and sends the signal to the controller. The controller may be a CPU that may be programmed to compare the detected speed and direction of movement with a predetermined speed limit and direction of movement. If the detected speed exceeds the inputted speed limit and the elevator is moving in the downward direction, the controller generates a signal which it sends to the actuator. Upon receipt of the signal, the actuator causes the brake arms to arrest the movement of the ram.

Other features of the present invention are described below, and others will no doubt occur to those skilled in the art upon reading and understanding the following detailed description along with the accompanying drawings.

BRIEF DESCRIPTION OF THE DRAWINGS

FIGS. 8A–8D are collectively a flowchart illustrating the operation of the controller of FIG. 7 according to a preferred embodiment of this invention.

DETAILED DESCRIPTION OF THE PREFERRED EMBODIMENTS

The drawings show a safety brake system according to the present invention, indicated generally by the reference number 1. Although the brake system 1 is applicable to many hydraulic ram or piston devices, it is described here in its preferred use on a hydraulic ram lifting elevator. References to "up", "down", "vertical", "horizontal", etc., should be understood to refer generally to the relative positions of the components of the illustrated device, which could be otherwise oriented or positioned in other directions. Further, although the term "hydraulic" is used, this invention could be used on any device with a similar configuration, i.e., a main cylinder surrounding a second cylinder. References to "hydraulic" should be understood to refer generally to any pressure ram device including but not limited to hydraulic and pneumatic ram devices.

Figure 1:
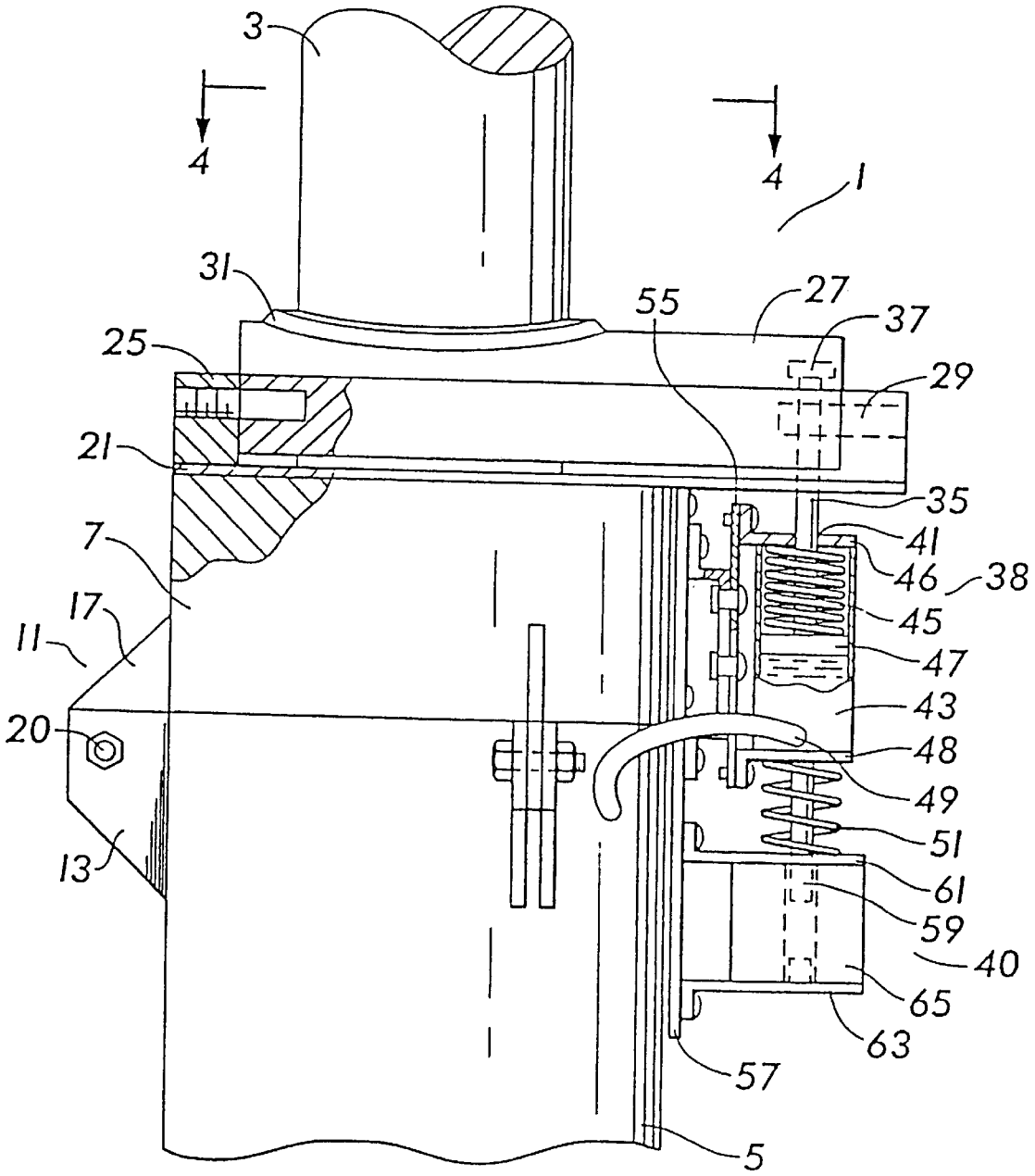
FIG. 1 is a side elevation view showing the brake and control components according to a preferred embodiment of the invention.
Figure 4:
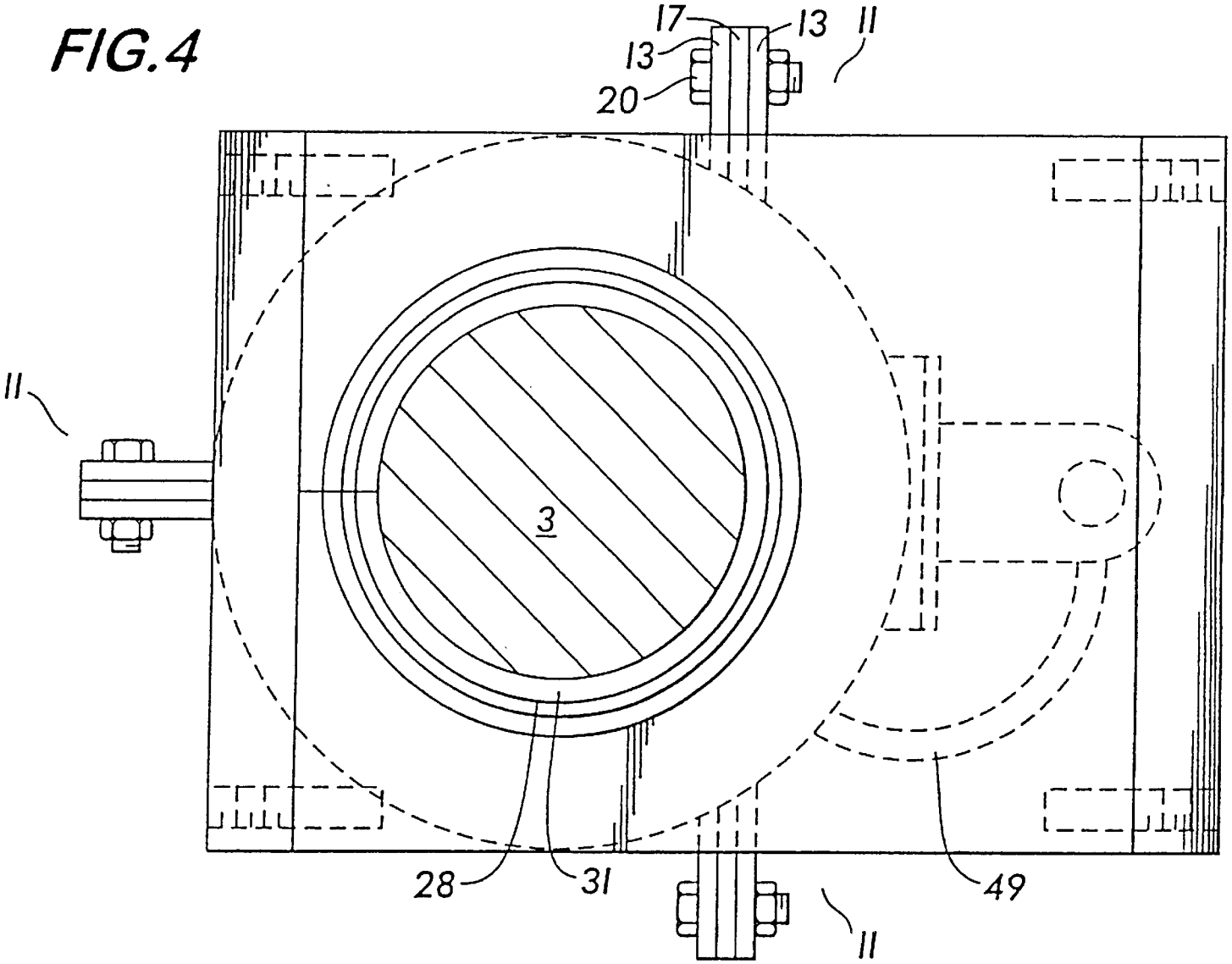
FIG. 4 is a plan view of the preferred embodiment depicted in FIG. 1, as viewed along the line 4—4.

In FIG. 1, a reciprocal piston or ram 3 is shown with brake system I installed on the existing main cylinder 5. Spacer ring 7 rests upon the upper end of the main cylinder 5 and is removably fixed to the upper end of the main cylinder 5 by any one of a number of known fastening means. In a preferred embodiment, the known fastening means comprises a plurality of eyelets 11 fixed to the outside surface of the main cylinder 5 near its upper end. Each eyelet 11 comprises a pair of flanges 13 affixed by welding or other similar means to the main cylinder 5 and spaced a short distance apart. Additionally, the eyelets 11 include a plurality of flanges 17 affixed to the exterior of spacer ring 7. Both the flanges 17 and the flanges 13 have bolt holes. By aligning the bolt holes and connecting them with an eyelet bolt 20, the spacer ring 7 is mated to the main cylinder 5, as best seen in FIG. 4. Although three eyelets 11 and their associated flanges 13, 17 are depicted in FIG. 4, it will be appreciated that a braking system of this invention may have any number of these eyelets 11. In an alternative embodiment, the eyelets 11 may comprise only a single flange.

Figure 3:
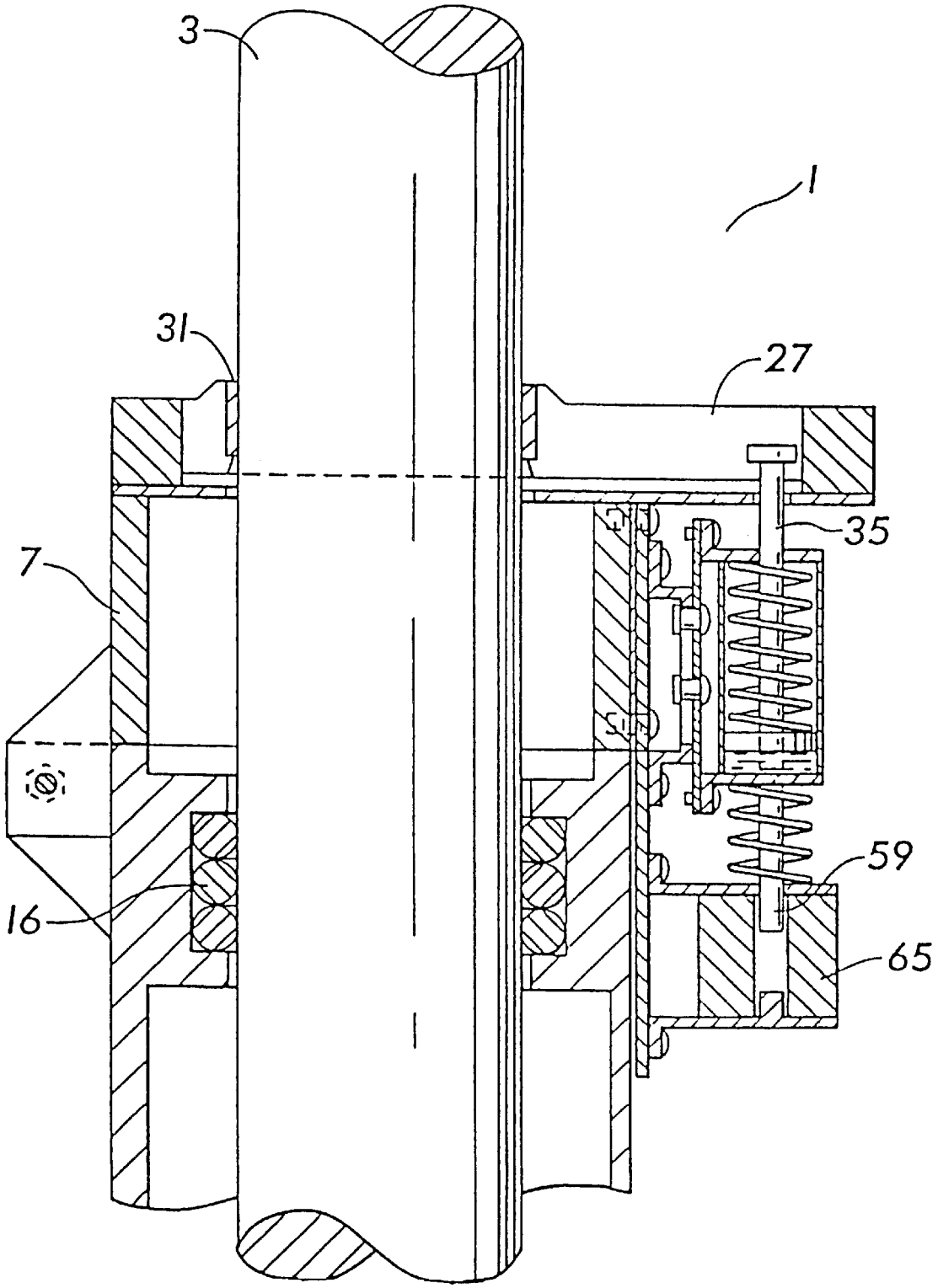
FIG. 3 is a sectional view showing the frictional contact and the location of the packing according to the preferred embodiment depicted in FIG. 1.

The advantage of using eyelets 11 is that any one of the eyelets 11 can act as a pivot to rotate the brake system 1 away from main cylinder 5 to allow access for servicing when the eyelet bolts 20 are removed from the other eyelets 11. For instance as shown in FIG. 3 and discussed below in further detail, the main cylinder 5 may have packing 16 installed to prevent oil leakage. It is not uncommon for this packing 16 to be replaced periodically. By removing all of the eyelet bolts 20 except one, the spacer ring 7 and the brake system 1 can be pivoted about the installed eyelet bolt 20 to access the packing 16 for repair or replacement. Additionally, removal of all of the eyelet bolts 20 would permit total removal of the brake system I for major work. If all of the bolts 20 are removed, the device can be easily rotated for access to the packing 16 without the need to disconnect electrical wiring or hydraulic connections. Eyelets 11 also facilitate proper alignment of the brake system and the main cylinder 5 upon mating them.

Given the generally small distance from the bottom of a standard hydraulic lift elevator to the top of the existing piston cylinder structure, a low profile device is desirable. The present device in ready position is between four and five inches high. This is accomplished by keeping the fulcrum angle, the angle between the brake arms 27 and base plate 21, at 15 degrees as shown in the drawings, best seen in FIG. 2. Because the system is of a low profile construction, it is easily mounted onto all existing elevator cylinders.

Packing 16 shown in FIG. 3 varies from elevator to elevator depending on the manufacturer. The length of spacer ring 7 is dependent upon the type of packing 16 employed. In general, the packing 16 is located in the cylinder head at the top of the cylinder 5. The packing 16 is the seal which retains oil pressure between the main cylinder 5 and the ram 3. Oil is used so that the relatively smooth ram 3 slides relatively freely into an out of the main cylinder 5. Generally, there is some bypass of oil through this seal. When this bypassed oil is excessive, it is customary to change the packing as described above.

Figure 2:
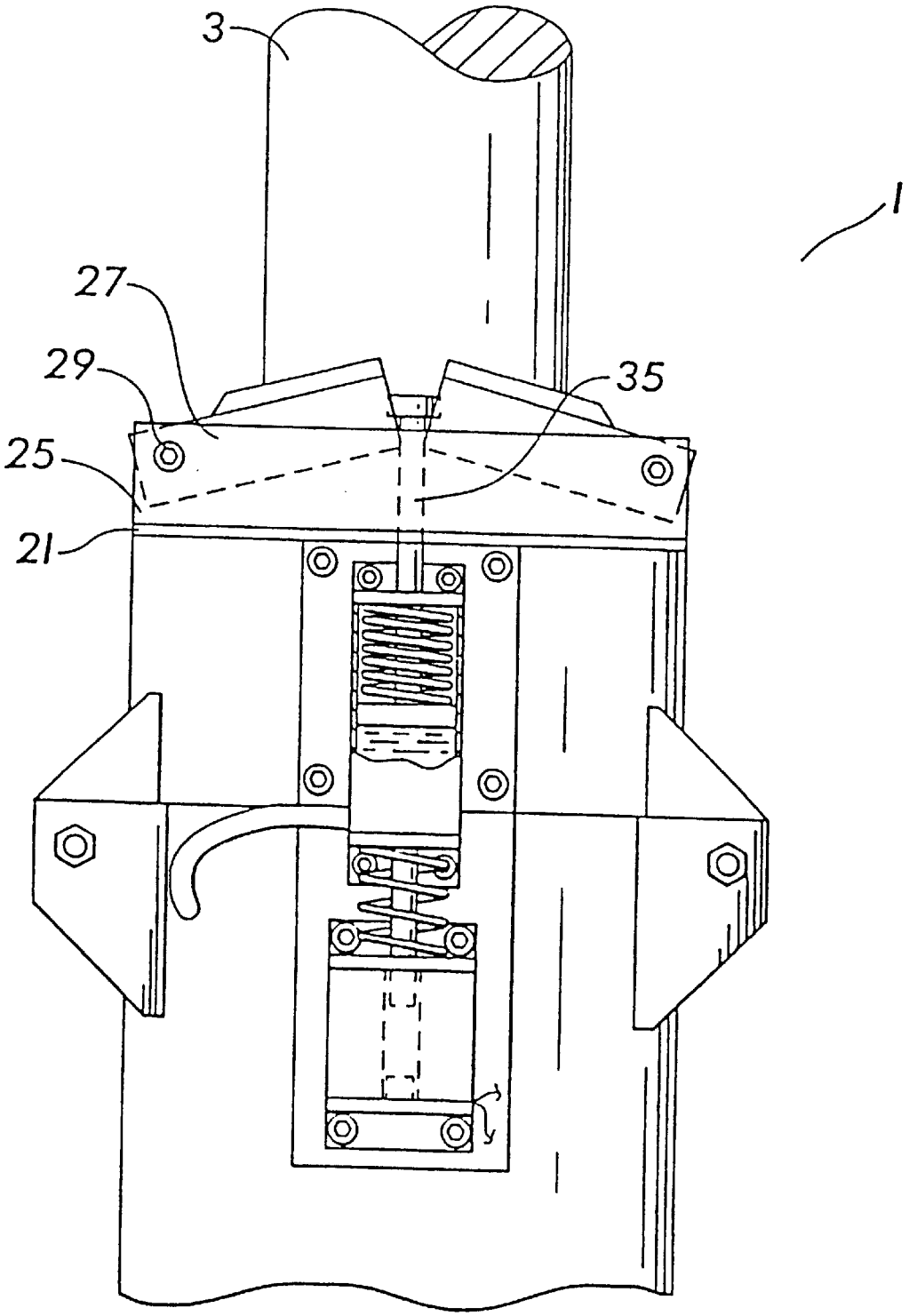
FIG. 2 is a front elevation view of the preferred embodiment depicted in FIG. 1.

Base plate 21 is fixed to the upper surface of spacer ring 7. Buttress members 25 are fixed to base plate 21. In the preferred embodiment, the brake arms 27 are hingeably fixed to buttress members 25 by pivot bolts 29 allowing the brake arms 27 to rotate into or out of contact with ram 3, as is best shown in FIGS. 1 and 2. Although the presently preferred embodiment uses two brake arms 27, a multiplicity of brake arms can be used. Each of the brake arms would take the form of a segment and would form a section of the ring around the ram 3. These sections can be equal in size, or they could be disparate, if desired. Differently sized sections may be advantageous in some situations, including where the configuration of the work space makes installation or maintenance easier if a certain portion of the brake system 1 is more articulated.

In ready or standby position, brake arms 27 are raised 15 degrees from horizontal, allowing travel clearance of ram 3, as best seen in FIG. 2. Brake arms 27 are shaped having semicircular cut-outs, as best seen in FIG. 4, of diameter slightly larger than ram 3, and have a friction material 31 mounted on the inside of the cutouts. This frictional material may be either an accretable material or a nonaccretable material. An accretable friction material is a material which causes friction by adhesion of the friction material to the moving surface which it contacts. This may involve actual material transfer or "accretion" of the accretable friction material onto the moving surface. Even more specifically, the term "accretive" may refer to the transfer of a softer material to a harder material. Thus, in this invention when the frictional material 31 contacts the harder material of the ram 3, which is preferably steel, some of the frictional material 31 may be transferred to the ram 3.

Furthermore, the frictional material 31 used in this invention preferably has a yield strength and a Brinell hardness number that is less than that of the ram 3. By having a lower yield strength and Brinell Hardness number, the frictional material 31 acts as a sacrificial layer and yields before the ram 3. This prevents destructive damage to the ram 3. As is discussed in further detail below, when the brake arms 27 are actuated, the frictional material 31 circumferentially engages the ram 3. When the frictional material 31 engages the ram 3, a frictional force is developed and the ram 3 is squeezed elastically. The forces generated by the friction between these components and the elastic deformation of the ram 3 arrest the movement of the ram 3. Since the Brinell hardness number and the yield strength of the ram 3 are greater than that of the frictional material 31, the contact between these components will not cause substantial permanent deformation of the ram 3. More specifically, the frictional material 31 will yield or scratch before the ram 3. Therefore, any scratching or nonelastic deformation will occur on the frictional material 31 and most if not all of the deformation of the ram 3 will be elastic. Consequently, the ram 3 is not substantially deformed when the brake arms 27 are activated to arrest its movement.

The precise reason why the ram 3 stops most likely can be attributed to one of two forces or the combination of these forces, the elastic squeezing force and the frictional force. As the ram deforms elastically due to the elastic squeezing, its cross sectional area changes. Since stress is inversly related to the area, as the area decreases due to the elastic deformation the stress increases. This increase in stress is significant and may be great enough, depending on the size of the elevator, by itself without the frictional force to stop the motion of the ram.

Stopping elevator motion by squeezing it elastically is important because it minimizes the effect contaminants have on a stopping force. Contaminants such as hydraulic oil or the like can be interposed between the frictional material and the ram 3. If this occurs, contact between the frictional material 31 and the ram 3 is diminished and the frictional force decreases. Potentially, contaminants could reduce the frictional force to a point where it is not great enough to stop the motion of the ram 3. The elastic squeezing force is not significantly affected by the presence of contaminants and therefore, stopping the ram with an elastic squeezing force has an advantage over a frictional force.

In a preferred embodiment the frictional material 31 is copper, but other materials may be used. Copper is preferred because, of the materials tested, it has the greatest tendency to adhere to the ram 3, and therefore it maximizes the amount of friction between the ram 3 and the brake lining 31. Maximizing the friction between these components creates the greatest braking force with the least amount of damage/deformation to the ram 3 and the braking system 1. Furthermore, its yield strength and Brinell hardness number are sufficiently below that of steel, so that the copper will either undergo nonelastic deformation or scratching before the ram. Moreover, the Brinell hardness number and the yield strength of copper are sufficiently high enough so that it can provide an adequate braking force without failing and without permanently deforming the ram. If these properties were too low, then the frictional material would not be able to provide the requisite braking force. Copper also has sufficient fatigue strength so that it will not fail after a few cycles. The inside diameter of the circle formed by the frictional material 31 is slightly smaller than the outside diameter of the ram 3. This provides proper engagement with ram 3 to bring the elevator to a halt.

Figure 5:
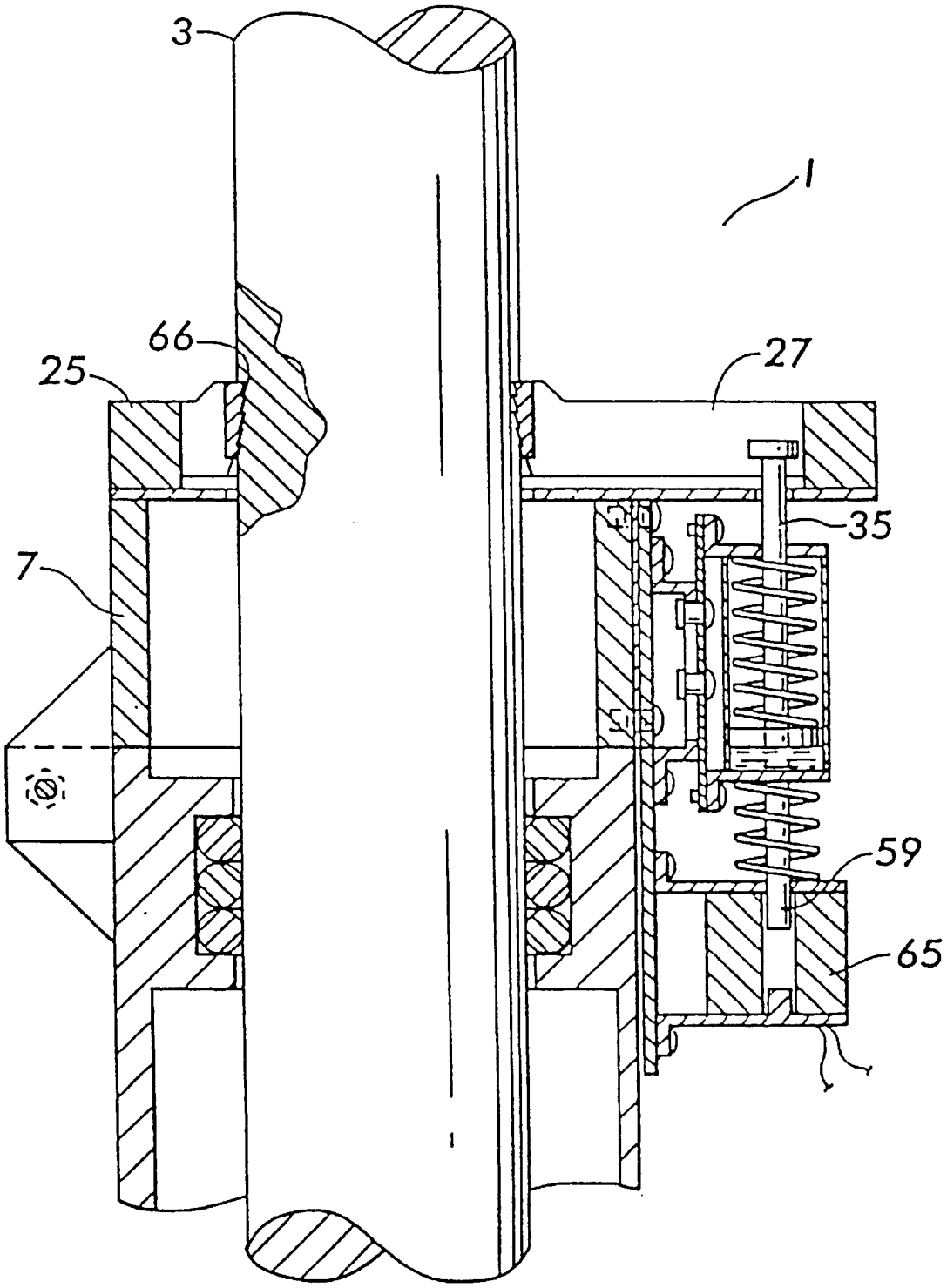
FIG. 5 is a sectional view of a brake and control components according to another preferred embodiment of this invention.

In an alternative brake arm embodiment, illustrated in FIG. 5, cutting bits or teeth 66 may be fixed to the friction material mounting surface 28 of brake arms 27 in place of or in addition to frictional material 31. In this embodiment, braking is accomplished by the teeth biting into the ram 3. Unlike the hour glassing damage caused by the prior art, the type of damage caused by this embodiment can be repaired by filling and filing the gouges.

Other systems for hingeably fixing brake arms 27 to buttress members 25 are possible. In an alternative hinge embodiment, hinge bolts may be used. In the hinged bolt embodiment, not shown, the rear side of brake arms 27 opposite the semicircular cut-outs are oriented against buttress members 25 rather than lying between them as in the preferred embodiment. Brake arms 27 are spaced from buttress members 25 a distance sufficient for brake arms 27 to be rotated upwardly 15 degrees from horizontal. A plurality of hinge bolts pass through holes in buttress member 25 into the rear edge of brake arms 27 and are threadably fixed thereto. Bending of the hinge bolts allows pivotal motion of brake arms 27.

In another alternative hinge embodiment, also not shown, a slide hinge may be used. In this alternative embodiment, the side of brake arms 27 opposite the side nearest ram 3 are, again, oriented against buttress members 25 rather than lying between them. Buttress member 25 has a concave channel to partially receive the rear edge of the brake arms 27, and the rear edges of the brake arms 27 are rounded to fit the concave surface of the buttress members 25. During pivotal movement of the brake arms 27 the rounded rear edges of the brake arms 27 slide within the concave surface of the buttress member 25.

FIG. 3 shows the brake system 1 in an actuated position. Friction material 31 is in contact circumferentially with ram 3. Further travel downward by brake arms 27 is prevented by contact with base plate 21. Spacer ring 7 transfers kinetic energy from the brake arms 27 and base plate 21 onto the main cylinder 5 or any associated support structure which may exist. Eyelets 11 and the structural strength of spacer ring 7 prevent brake system 1 from slipping and assure approximately equal transfer of force directly downward, into existing main cylinder 5 or onto any associated cylinder support structures. Kinetic energies can be limited by limiting the downward speed allowed before the brake system 1 is actuated, thereby preventing damage to the brake system 1, the ram 3 or the main cylinder 5.

Hydraulic actuation of brake arms 27 is accomplished by the hydraulic actuation assembly 38. The hydraulic actuation assembly 38 includes feedback control cylinder 43 and actuation rod 35. The top of the actuation rod 35 has a disc or rectangular shaped metal wafer 37 that is received inside shaped hollows or routs in the brake arms 27. As best shown in FIG. 1, the feedback control cylinder 43 is fixed between upper hydraulic cylinder bracket arm 46 and lower hydraulic cylinder bracket arm 48 of hydraulic cylinder bracket 55. Bracket arms 46, 48 are fixed to hydraulic cylinder bracket 55, which is fixed to the spacer ring 7.

Feedback cylinder 43 has a portal to receive the lower end of actuation rod 35, a plunger 47 fixed to the lower end of actuation rod 35, and a helical compression spring 45, as is best depicted in FIG. 1. The helical compression spring 45 is engaged over and around the lower end of the actuation rod 35, and is compressed between the inside surface of the top of feedback cylinder 43 and the other end of engaging plunger 47. Pressurized fluid such as hydraulic oil, is ported from main cylinder 5 through hose 49 to the feedback cylinder 43.

Helical compression return spring 45 urges plunger 47, and actuation rod 35 fixed thereto, downward. Under normal conditions, the pressurized fluid in feedback cylinder 43, overcomes the compressed spring energy of return spring 45, and urges plunger 47 upward, which in turn urges control rod 35 upward, which then urges brake arms 27 into ready or standby position.

Loss of hydraulic pressure in the main cylinder 5 is communicated to feedback cylinder 43 through hose 49 (FIGS. 1 and 2). If this occurs, return spring 45 overcomes the reduced pressure in feedback cylinder 43 urging plunger 47 and the attached actuation rod 35 downward and thereby, pulling brake arms 27 into contact with ram 3, as shown in FIG. 3. Friction resulting from the contact of the frictional material 31 with the ram 3 urges brake arms 27 further downward into contact with ram 3, until the brake arms 27 rest on the horizontal base plate 21. As this occurs, the friction material 31 on the brake arms 27 frictionally engages the ram 3 and elastically squeezes the ram 3 with sufficient force to stop the downward motion of the ram 3. Although most of the deformation of the ram 3 is elastic, and preferably all of it is elastic, a slight amount of plastic deformation may occur. Thus, the frictional force and the elastic squeezing of the ram 3 stop the motion of the ram 3.

As depicted in FIG. 1, electronic actuation of brake arms 27 may be accomplished by the electronic actuation assembly 40, which is rigidly affixed to the spacer ring 7 by control bracket 57, upper solenoid bracket arm 61, and lower solenoid bracket arm 63. Electronic actuation assembly 40 comprises electronic activator rod 59 and helical compression support spring 51 placed over and around electronic actuation rod 59. The upper end of support spring 51 engages the lower surface of hydraulic control assembly 38, and the lower end of support spring 51 engages the upper surface of solenoid bracket 61.

In this preferred embodiment, electronic activator rod 59 is fixed at its upper end, generally, to the hydraulic actuation assembly 38. As is best depicted in FIG. 1, the hydraulic activation assembly 38 is mounted on bracket 55 which may be a slide bracket. Bracket 55, for example, may be fixed to control bracket 57, so that it can slide or translate in either an upward or downward direction.

Solenoid helical compression support spring 51 is selected to support the weight of brake arms 27 and hydraulic actuation assembly 38. Tubular solenoid 65 is mounted in the control assembly 40 which is fixed between upper and lower solenoid bracket arms 61 and 63. The lower end of electronic actuation rod. 59 partially penetrates tubular solenoid 65 as is best shown in FIGS. 3 and 5. The upper end of electronic actuation rod 59 is coupled to the underside of lower hydraulic cylinder bracket arm 48. An electronic signal from a down overspeed detector 302 or an uncontrolled downward motion detector 301, shown schematically in FIG. 6, causes an electric current in solenoid 65. This current generates a magnetic field of sufficient strength to urge electronic actuation rod 59 downward into tubular solenoid 65, thereby pulling the entire hydraulic actuation assembly 38 downward. Since the assembly 38 is attached to the brake arms 27, they are actuated when the assembly 38 moves in the downward direction.

In an alternative embodiment, not shown, the electrical actuation assembly 40 is the same as described above, except no hydraulic actuation assembly 38 is used. Instead, electronic actuation rod 59 is engaged directly with brake arms 27. In this embodiment, an electronic signal from a hydraulic pressure detector can also be used to actuate electronic actuation assembly 40, in addition to a down over speed or uncontrolled downward motion detector.

Figure 6:
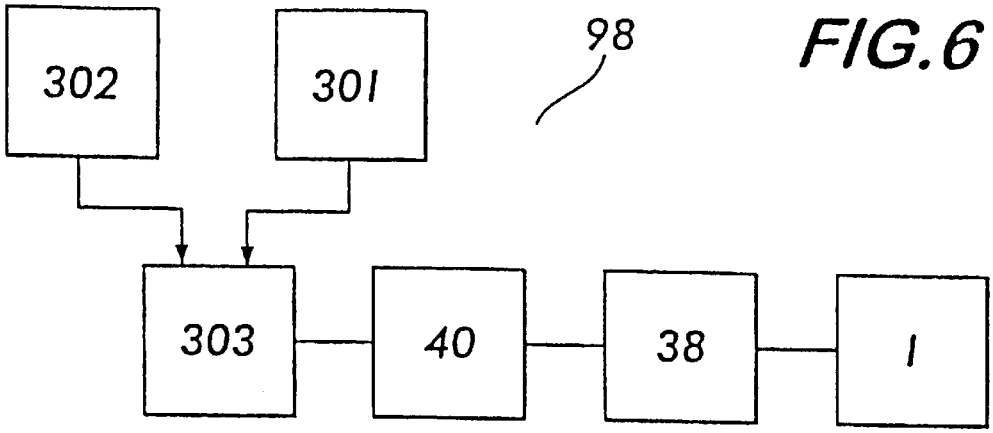
FIG. 6 is a schematic view of a control system according to a preferred embodiment of this invention.

A schematic view of a control system 98 that employs the electronic actuation assembly 40 is depicted in FIG. 6. This system includes either or both an overspeed detector 302 and/or an uncontrolled downward motion detector 301, a controller 303, the electronic actuation assembly 40, the hydraulic actuation assembly 38 and the brake system 1. A variety of known down over speed or uncontrolled downward motion detectors are available for use with this invention. For example, these devices may include those disclosed in Coy, U.S. Pat. No. 4,638,888, which discloses an electronic system for detecting the hydraulic pressure in an elevator ram piston cylinder, and Ericson, U.S. Pat. No. 5,052,523, and Sobat, U.S. Pat. No. 3,942,607, which both disclose mechanical means for detecting the downward speed of an elevator. The specifications of these patents are hereby incorporated by reference in their entirety. The details of the other components have been described above. In this system the detector 302 and/or the sensor 301 determine if either of their respective conditions are present. If either of the conditions are present, this information is inputted to the controller 303. The controller 303 generates a signal in response to these conditions to activate the solenoid 65 of the electronic actuation assembly 40. In response, the solenoid 65 communicates with the hydraulic actuation assembly 38, and the hydraulic actuation assembly 38 operates the brake system 1 to stop the ram 5 and the elevator 120. The details of these operations are described above.

Figure 7:
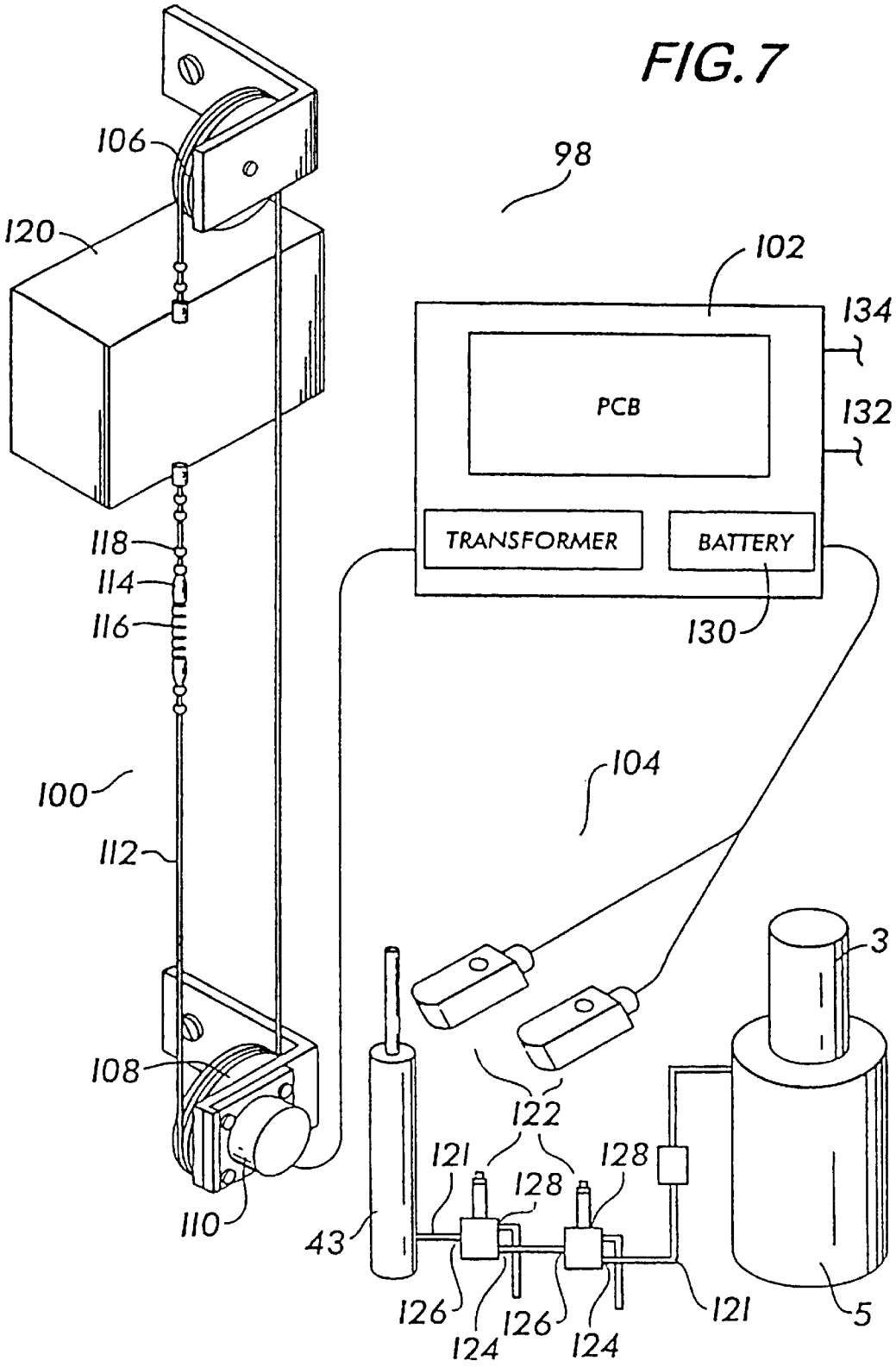
FIG. 7 is an isometric view of a control system according to another preferred embodiment of this invention.

Despite the availability of known control systems, a further aspect of the present invention is the provision of an improved control system 98. Such a control system 98 is described with reference to FIGS. 7 and 8A–8D and includes a detection system 100, a controller 102 and an operating mechanism 104. The detection system 100 includes a pair of sheaves 106, 108, an electrical generator 110 and a wire rope 112 attached to an elevator 120 by conventional means, such as cable thimbles 114, springs 116 and clamps 118. FIG. 7 is a an isometric view of a preferred embodiment of this control system 98. Although not all of the components of the brake system 1, the ram 3 and the main cylinder 5 described above are depicted in this Figure, it will be appreciated that they may be employed with this control system 98. For example, the main cylinder 5 and the feedback cylinder 43 are shown in FIG. 7. However, the orientation of these components to each other is different in FIG. 7 for illustrative purposes only and they can be configured as shown in FIGS. 1–5. Furthermore, it will be understood that although the ram 3 and the elevator 120 are not mechanically connected in FIG. 7, these components are mechanically connected in a conventional manner so that movement of the ram 3 causes movement of the elevator 120. Again, the mechanical connection between these components is not illustrated in FIG. 7 so that other aspects of the control system 98 can be more clearly explained.

As shown in FIG. 7, the wire rope 112 is affixed to the top and bottom of the elevator 120 and runs over the sheaves 106, 108. In this embodiment, the top sheave is an idler sheave 106 and the bottom sheave is the drive sheave 108. In operation as the elevator 120 moves up and down the cable 112 moves with the elevator 120 and causes the sheaves 106, 108 to rotate. As the drive sheave 108 rotates it interacts with the electrical generator 110, which is preferably an encoder or similar device, to convert the rotation of the drive sheave 108 to electrical pulses and an electrical signal that corresponds to the speed of rotation of the drive sheave 108. Because the movement of the elevator 120 controls the speed of rotation of the drive sheave 108, the signal generated by the encoder 110 is indicative of the speed of the elevator. The number of pulses varies with the speed of rotation of the drive sheave 108. If the encoder has two phases, then one phase can be used to indicate the speed of the elevator and the other can be used to indicate the direction of motion of the elevator. Specifically, the second phase generates a signal that varies with the direction of rotation of the drive sheave 108 and therefore, the direction of movement of the elevator 120.

The encoder 110 or similar device is preferably wired to the controller 102 shown in FIG. 7. The controller 102 is preferably a central processing unit (CPU) that functions as described in detail below to activate the brake system 1 if the speed of the elevator 120 exceeds a predetermined speed limit. In general terms, the controller 102 is programmed to continuously compare actual elevator motion to desired motion. If certain conditions are present, such as the elevator speed exceeding an inputted speed limit or traveling in a direction other than the intended direction of travel, the controller 102 activates the operating mechanism 104 to operate the brakes. The CPU has two independent driver circuits to ensure that, should one fail, a failsafe circuit exists. Furthermore, the controller 102 may be powered by a battery 130 or an external electrical power source 132. Preferably, the controller 102 has a switch 134 that may be operated to set a speed limit for the elevator. The switch 134 can be any one of a number of conventional electrical switches, such as a dipswitch.

Included within the operating mechanism 104 is an actuator 122. In the preferred embodiment illustrated in FIG. 7, the actuator is a pair of solenoid operated three way valves. Two valves are used for purposes of redundancy, however, one valve could be used. The valves are connected in series by conduits 121 or similar connecting devices between the main cylinder 5 and the feedback cylinder 43. The valves each have three ports. A first port 124 connects the valves to the main cylinder 5, a second 126 to the feedback cylinder 43 and a third 128 to a dumping area, such as a tank (not shown). Since the valves are solenoid operated valves, they can be positioned to connect any two of these ports together in response to an electrical signal.

In a first position the third port 128 is closed on each of the valves and hydraulic fluid is sent from the main cylinder 5 to the feedback cylinder 43. As discussed above, when pressurized fluid is sent to the feedback cylinder 43, the brake system 1 is in the raised position and the ram 3 is free to travel in and out of the main cylinder 5. Should the controller 102 generate a signal in response to a detected emergency condition, this electrical signal is sent to the valves. The valves then reposition to permit fluid flow from their second port 126 to their third port 128. In this position, fluid cannot flow from the main cylinder 5 to the feedback cylinder. Thus, in this position the feedback cylinder 43 is vented and is not pressurized. This causes the brake arms 27 to actuate as described above in detail. If either valve repositions in response to the signal generated by the controller 102, the feedback cylinder 43 will vent and activate the brake system 1. Consequently, use of two valves provides a safety feature that protects against one of the valves failing.

Figure 10:
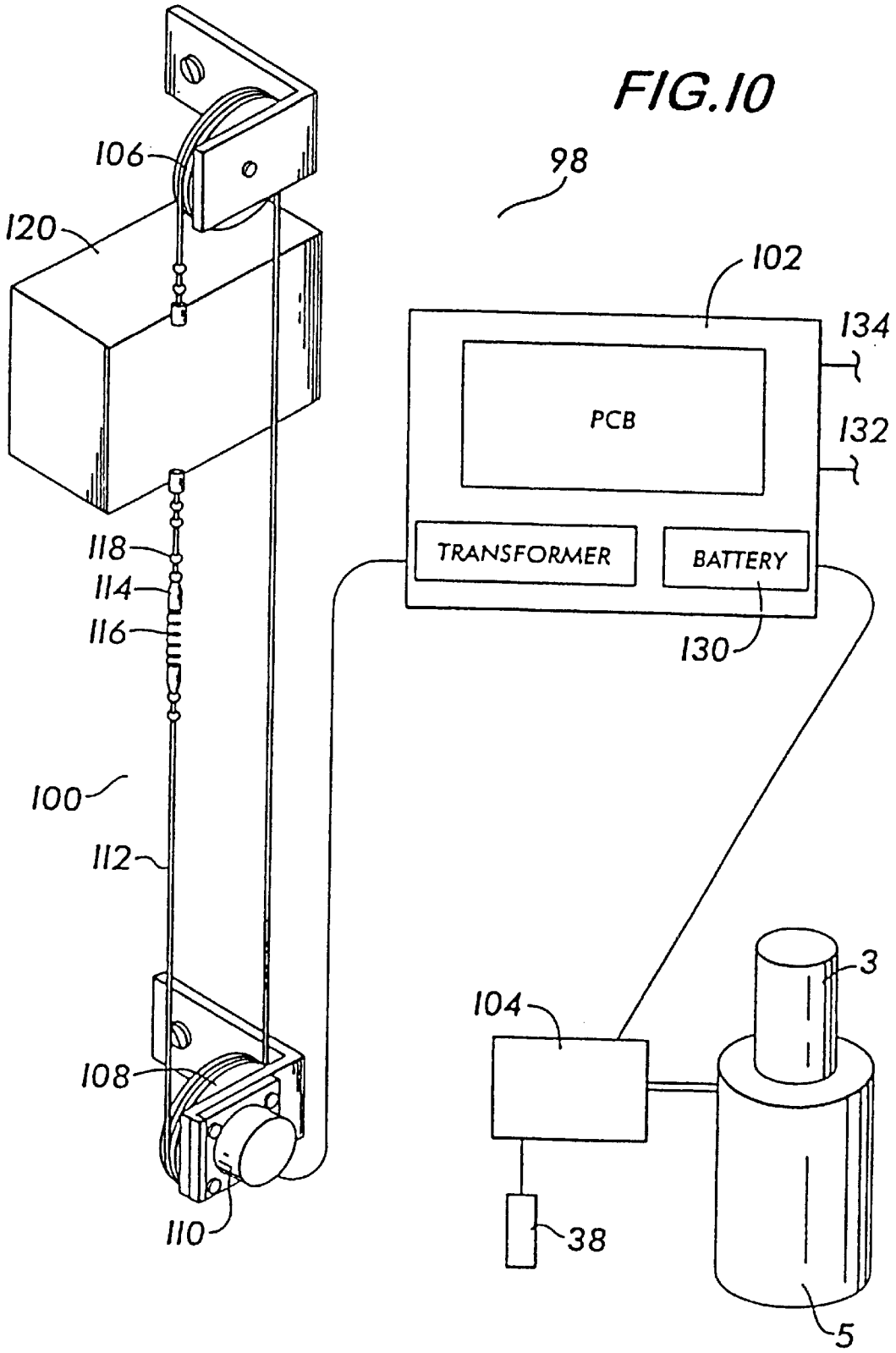
FIG. 10 is an isometric view of a control system according to another preferred embodiment of this invention.

FIG. 10 illustrates another preferred embodiment of the control system 98. This embodiment depicted in FIG. 10 is similar to that described with reference to FIG. 7 with the exception that the operating mechanism 104 differs. Specifically, in this embodiment the operating mechanism is a manifold, as opposed to the valves and the feedback cylinder described above. Within the manifold may be a valve or port connecting the main cylinder 5 to a source of hydraulic pressure for the hydraulic actuation assembly 38. The position of this valve or port can be repositioned by the controller 102 to stop flow from the main cylinder 5 to the source of hydraulic pressure, and then another valve or port can be repositioned to vent the source of pressure. As the source of pressure is decreased, the pressure at the hydraulic feedback assembly 38 decreases and the brake is activated as described above.

Figure 9:
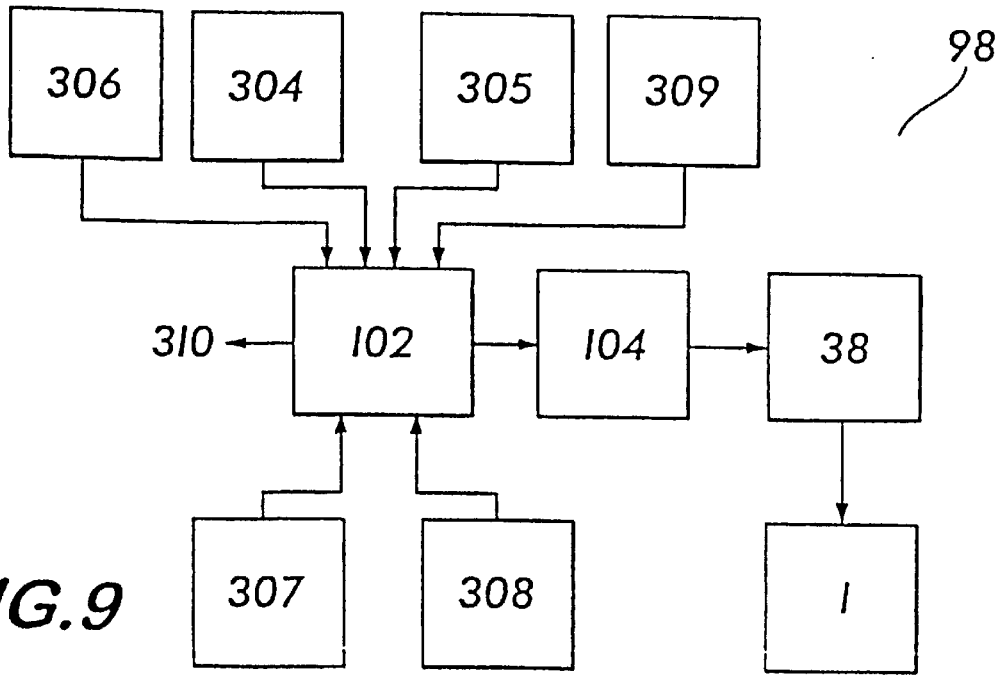
FIG. 9 is a schematic view of the control system depicted in FIG. 7.

A schematic diagram of a preferred embodiment of this control system 98 is illustrated in FIG. 9. As is shown in this Figure, the controller 102 receives inputs that include the actual speed 306 and actual direction 304 of travel of the elevator and a desired speed 305 and desired direction 309 of travel of the elevator. Additionally, the controller 102 receives inputs from the elevator's upcoil 307 and downcoil 308. As is well known in the art, these coils are respectively energized to move the elevator in either an upward or a downward direction. By comparing the desired inputs 305, 309 and the status of the coils 307, 308 to the actual inputs 306, 304, the controller 102 determines if an emergency condition is present. The specific details of the operation of the controller 102 are provided below. If such a condition is present, the controller 102 activates the operating mechanism 104. The operating mechanism 104 actuates the hydraulic actuation assembly 38, which operates the brake system 1, as described above. Additionally, the controller 102 may activate either or both an aural and/or a visual alarm 310.

As is shown in FIGS. 8A–8D, the CPU of this invention can be programmed to control the brake system if one of a number of conditions should occur. For example, the brake device can be activated if the speed of the elevator in the downward direction exceeds a predetermined speed limit.

As mentioned above the CPU is contained within the controller 102 and has several outputs. For instance, it can illuminate lights and sound alarms that are indicative of an alarming condition or maintenance condition. Alarming conditions may include the elevator traveling at an excessive speed or in the wrong direction.

As is typical of computer programs, the program begins by initializing itself (step 140). While the CPU is exercising the initialization program it may illuminate a display indicating that it is executing this portion of the program (step 142). During the initialization process, the CPU may determine if a "warning condition" exists (step 144). The warning conditions may include a fuse missing or "blown," the battery at a low level or missing and/or the number of instances in which the brake has been operated, a brake cycle, exceeding a predetermined brake cycle limit. Because after a certain amount of cycles, the frictional material may have eroded, a limit is set for the number of cycles that the brake can endure before the frictional material should be checked and/or replaced. If any of these warning conditions are present the CPU may activate an audible alarm or set the brake (step 145).

If no warning condition is found, the CPU may calculate the maximum speed for the elevator (step 148) and display indications that the system is operating (step 150). These indications may be lights, printouts or other similar indications. This speed may be calculated by receiving inputs from an operator with a device such as a dip switch, denoted by reference number 134 in FIG. 7, or a similar apparatus. The controller 102 may also receive inputs from a test device (not shown), commonly known as a service tool, that can be used to test the operation of the CPU. Such a device includes a numerical keypad and an LCD display and can be operated remotely by connecting the tool to the controller with a serial cable. The service tool is used to input signals to the CPU and check its response to the signals to ensure it is functioning properly.

After calculating the maximum speed for the elevator, the program receives inputs (step 152) from the coils (not shown) that control the movement of the elevator.

Typically, an elevator has an up coil and a down coil that are electronically energized to respectively move an elevator in either an upward direction or a downward direction. After receiving these inputs, the CPU selects one of three subroutines that correspond to the state of the coils, either a down coil subroutine if the down coils are energized (step 154), an up coil subroutine (step 156) if the up coils are energized or a still service mode subroutine (step 158) if neither of the coils are energized.

In the down coil subroutine (step 154), input form the encoder 110 is received (step 160). The CPU then analyzes whether the speed signal received from the encoder is indicative of a speed approximately equal to zero (step 162). If the speed is approximately equal to zero, this indicates a problem with the system and the brake is set (steps 164, 166). For example, the encoder 110 may have failed. This condition is indicative of a problem because the downcoil is energized, and when the down coil is energized the elevator should be moving relatively rapidly. Consequently, if the indicated speed is approximately zero then a problem exists and the brake should be set.

If the speed is not approximately equal to zero, the CPU determines whether either a direction error, a battery fault or an encoder fault exists (step 163). If such a fault exists, the brake is set (step 165). If no fault is found, the CPU checks the speed and direction of the elevator as indicated by the encoder (step 167). After making these checks, the CPU evaluates whether the elevator 120 is traveling in the downward direction as it should be since the down coils are energized. If the encoder 110 indicates that the elevator is traveling in the upward direction, this indicates a problem and the CPU generates a direction alarm signal and activates an aural alarm (step 168). Additionally, the program executes the system status subroutine 210.

If the elevator 120 is not moving in the upward direction, the CPU then compares the indicated speed with the speed limit (step 170). If the speed limit is exceeded, the CPU generates a signal to operate the brake (step 172). In comparison, if the speed is less than or equal to the speed limit, the CPU then determines whether the speed of the elevator 120 is in the service area by evaluating whether the speed of the elevator is relatively low (step 174). Since typically an elevator does not travel at a relatively low speed, a relatively low speed is indicative of the elevator being serviced or in a maintenance condition. If the speed is in the service area, the CPU determines if either of the coils are energized or if the elevator is in still service mode (step 152). Conversely, if the elevator speed is not in the service area, the speed and direction are checked again (step 167) and the steps described above are executed in a repetitive fashion.

Figure 8A:
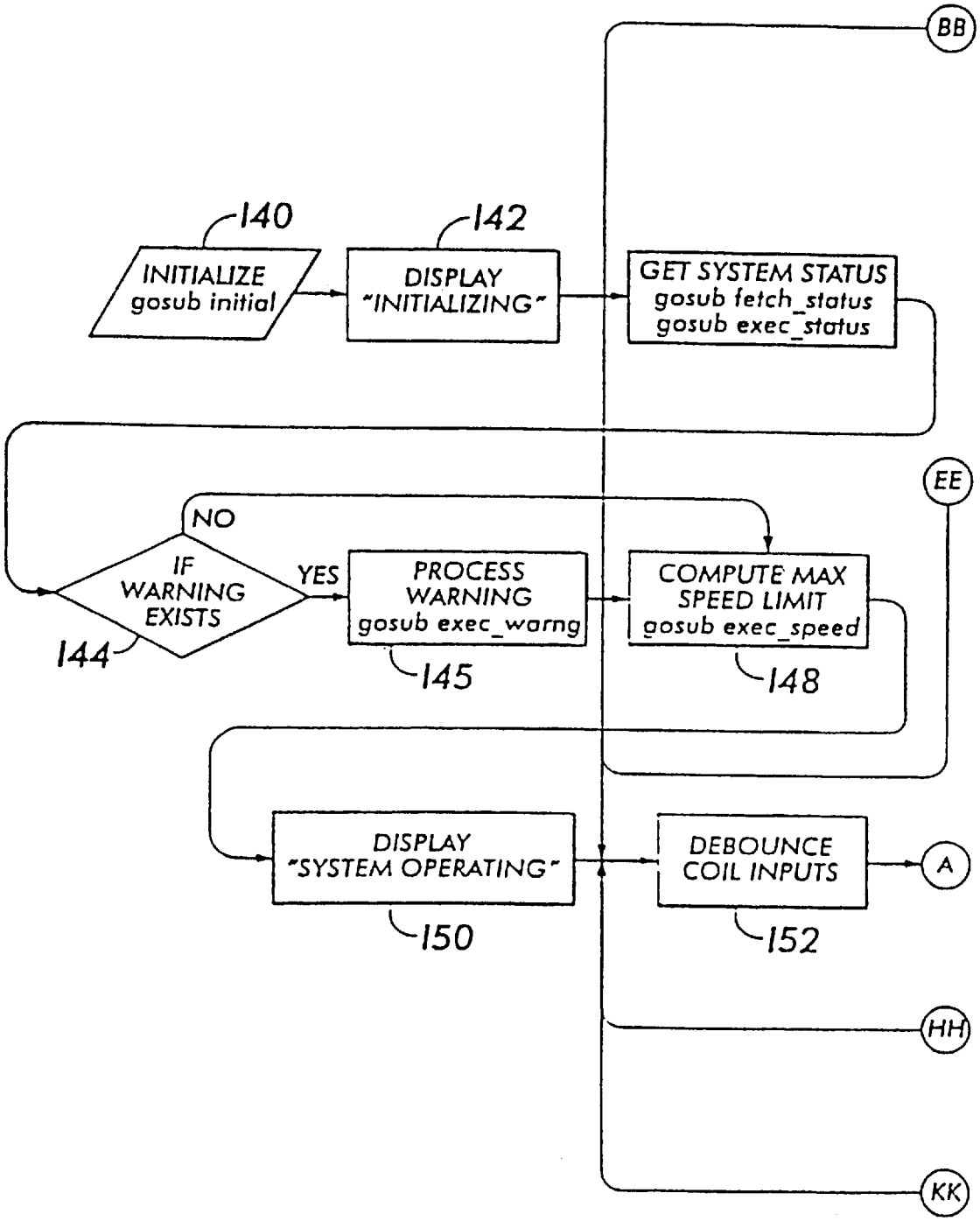
Figure 8B:
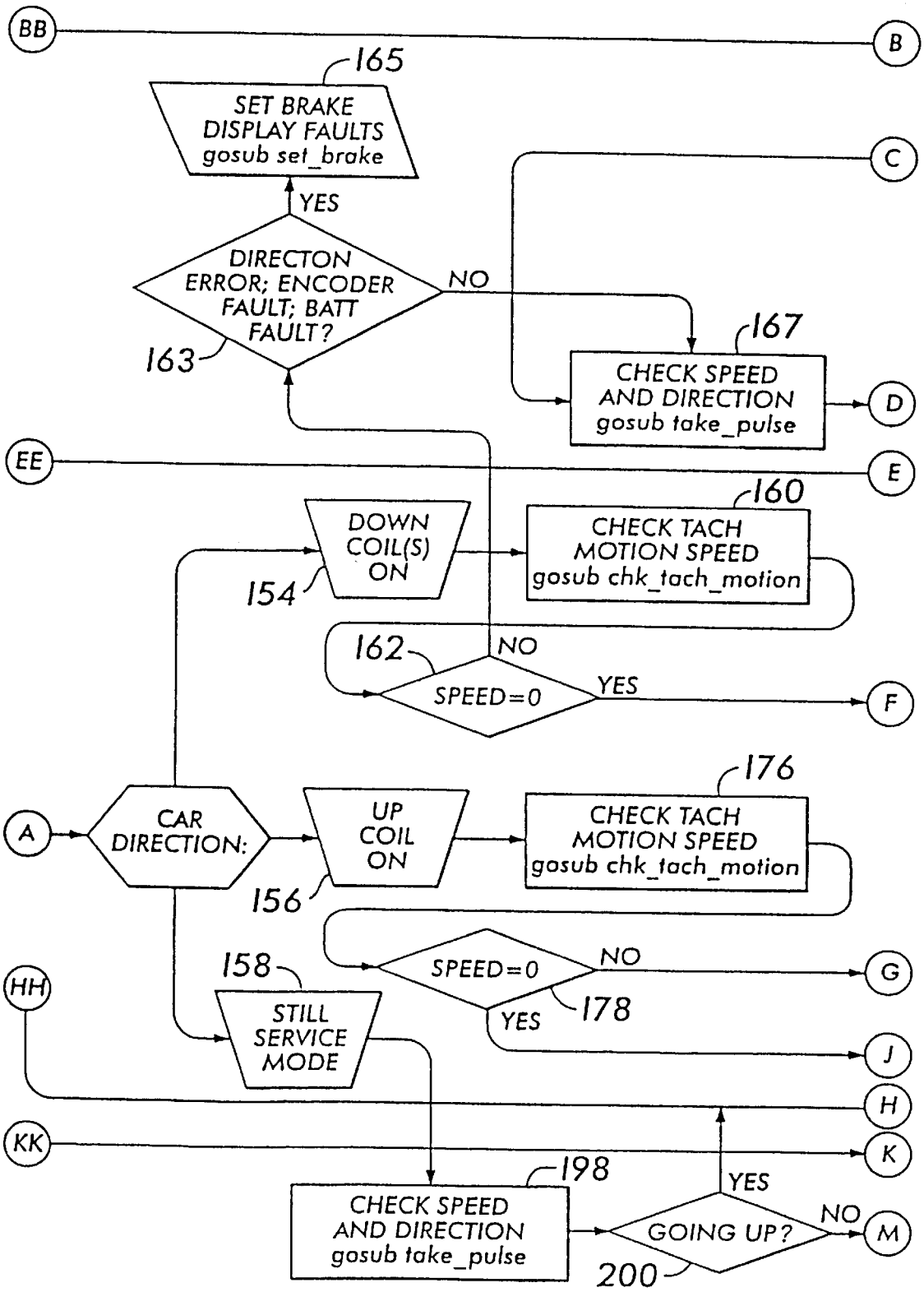

If the CPU determines that the up coils are energized, it will execute the up coil subroutine, as shown in FIGS. 8B–8D (step 156). Similar to the down coil subroutine (step 154), the up coil subroutine (step 156) inputs the speed of the elevator as indicated by the encoder (step 176) and determines if the indicated speed is approximately equal to zero (step 178). Similar to the description above with reference to the down coil, if the indicated speed is approximately equal to zero, this indicates a problem because the up coil is energized and the elevator should be moving. Therefore, if the indicated speed is approximately equal to zero, an encoder fault may be indicated and an audible alarm may be sounded (step 180). After sounding the alarm, the CPU reexecutes step 152 to determine the status of the coils.

If the speed is not approximately equal to zero, the CPU checks the operation of the encoder (step 182). If an encoder fault is detected, the CPU sounds an alarm (step 184) and reexecutes step 152 to determine the status of the coils. After it is determined that the encoder 110 is functioning properly, the CPU checks the direction of travel and the speed of the elevator 120 as indicted by the encoder (step 186) and determines if the inputted direction of travel is in the upward direction (step 188). If the elevator 120 is not traveling in the upward direction, the CPU sounds a wrong direction alarm (step 190) and compares (step 192) the elevator 120 speed to the service speed. If the elevator speed exceeds the service speed, the CPU operates the brake system (step 194). However, if the elevator is either moving in the upward direction or the service speed is not exceeded, the program executes the system status subroutine (step 210) as described below.

When neither of the coils are energized, this indicates that the elevator 120 should be still and the still service mode subroutine (step 158) is executed. In this subroutine (step 158), the CPU checks (step 198) the speed and direction of travel. Specifically, the direction of movement is determined if it is in the upward direction (step 200), the speed is evaluated to determine if it is approximately equal to zero (step 202) whether the elevator 120 speed exceeds a service speed limit is evaluated (step 204). If the elevator is moving upward, the CPU rechecks the status of the coils (step 152). If the elevator is not moving upward, the CPU determines if the speed is approximately equal to zero (step 202). If it is not approximately equal to zero, the elevator speed is compared to the service speed (step 204). If the indicated speed is greater than the service speed, the brake is set (step 206). Conversely, if the speed is either approximately zero or is less than the service speed, the system status subroutine is executed (step 210).

The system status subroutine (step 210) is executed as discussed above if (1) a direction error is indicated; (2) the elevator 120 is moving upward at a speed that is not approximately equal to zero with the upcoil energized; or (3) the elevator is moving up when the up coil is energized and is traveling at a speed below the service speed. In this subroutine (step 210), the CPU determines whether any of the parameters have changed (step 212). If the system status has changed, it checks the system parameters again (step 213), before determining whether the speed set point has changed (step 214). If the speed set point has changed, a new maximum speed limit is calculated (step 215). After either determining that the speed set point has not changed or after calculating a new speed limit, the CPU will then evaluate whether any warning flags are present (step 216). Warning flags may include a fuse missing or "blown," the battery at a low level or missing the number of brake cycles exceeding a predetermined limit, as described above, and/or one or both of the drivers for the controller not functioning properly. If warning flags are not detected, the CPU outputs diagnostic information in a typical display format for evaluation (step 218). If warning flags are present the CPU processes and displays these warnings in a conventional manner such as through lights or printed information (step 217) and displays diagnostic information (step 218). After displaying diagnostic information (step 218), the status of the coils is reevaluated (step 152).

A system of this type can be retrofitted to existing elevators, making it desirable not only to set the emergency brake but also to monitor less dangerous and equally important conditions. For instance, a common modern technique of scanning the exact locations of floor levels can be incorporated. Outputting "off level" information to the elevator controls alerts incoming and outgoing passengers of the hazard, or inhibits door operation altogether. Also, over speed conditions in the downward direction which may not be caused by a failure, but due to overloading, are detected and an output signal directing the elevator to slow down is implemented.

National, state and local codes provide regulations for periodic testing of safety devices, so it is desirable to retest without damaging either the ram or the brake. Prototype testing to date has shown less than twenty thousandths of an inch deformation of the copper at the open edges of the copper bar, where the brakes meet centrally when closed, and no deformation elsewhere.

The preferred embodiments described herein are illustrative only and, although the examples given include many specificities, they are intended as illustrative of only one possible embodiment of the invention. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

What is claimed:

1. A safety brake system for a hydraulic elevator having an elevator car coupled to a ram for moving the car in response to a selective application of hydraulic fluid to an associated cylinder and a brake for engaging the ram and preventing movement of the elevator car, the safety brake system comprising:

a brake having a pivotally mounted pair of brake arms each having a friction material mounted thereon, said brake arms and said friction material being shaped to circumferentially engage the exterior surface of the ram;

a brake operating mechanism connected to said brake arms for pivoting said brake arms between a ready position out of engagement with the ram and an actuated position in engagement with the ram;

a source of an electrical signal representing an operating condition of a hydraulic elevator car connected to the ram; and a brake controller connected between said signal source and said brake operating mechanism whereby, when said brake is installed on the hydraulic elevator system, one of said brake operating mechanism and said brake controller is responsive to a normal hydraulic pressure in a cylinder associated with the ram for maintaining said brake in the ready position and is responsive to a loss of the normal hydraulic pressure for moving said brake to the actuated position, said brake controller being responsive to said electrical signal for moving said brake to the actuated position when said electrical signal represents a predetermined operating condition of the elevator car.

2. The safety brake system according to claim 1 wherein said brake operating mechanism includes a hydraulic actuation assembly connected to said brake arms and adapted to be in fluid communication with the cylinder whereby said hydraulic actuation assembly is responsive to a normal hydraulic pressure in the cylinder for maintaining said brake in the ready position and is responsive to a loss of the normal hydraulic pressure for moving said brake to the actuated position.

3. The safety brake system according to claim 2 wherein said brake controller includes an electric actuation assembly connected to said hydraulic actuation assembly whereby said electric actuation assembly is responsive to said electrical signal for actuating said hydraulic actuation assembly to move said brake to the actuated position when said electrical signal represents said predetermined operating condition of the elevator car.

4. The safety brake system according to claim 3 wherein said brake operating mechanism includes an actuator adapted to be in fluid communication with the cylinder and being in fluid communication with said hydraulic actuation assembly, said brake controller being connected to said actuator for controlling said actuator to prevent fluid flow to said hydraulic actuation assembly whereby said brake is moved to the actuated position when said electrical signal represents said predetermined operating condition of the elevator car.

5. The safety brake system according to claim 1 wherein said brake controller includes an electric actuation assembly connected to said brake arms by said brake operating mechanism and being responsive to a pressure signal representing fluid pressure in the cylinder whereby said electric actuation assembly is responsive to said pressure signal representing a normal hydraulic pressure in the cylinder for maintaining said brake in the ready position and is responsive to said pressure signal representing a loss of the normal hydraulic pressure for moving said brake to the actuated position.

6. The safety brake system according to claim 1 wherein said brake controller includes an electric actuation assembly connected to said brake arms by said brake operating mechanism and a sensor connected to said electric actuation assembly for generating said electrical signal.

7. The safety brake system according to claim 6 wherein said sensor is an uncontrolled downward motion detector.

8. The safety brake system according to claim 6 wherein said sensor is an actual direction sensor and said electric actuation assembly compares said electrical signal with a signal representing a desired direction of travel of the elevator car.

9. The safety brake system according to claim 6 wherein said sensor is a down overspeed detector.

10. The safety brake system according to claim 6 wherein said sensor is an actual speed sensor and said electric actuation assembly compares said electrical signal with a signal representing a desired speed of the elevator car.

11. A safety brake system for a hydraulic elevator having an elevator car coupled to a ram for moving the car in response to a selective application of hydraulic fluid to an associated cylinder and a brake for engaging the ram and preventing movement of the elevator car, the safety brake system comprising:

a brake having a pivotally mounted pair of brake arms each having a friction material mounted thereon, said friction material having a Brinell hardness number less than a Brinell hardness number of material forming an exterior surface of a hydraulic elevator ram of a hydraulic elevator system, said brake arms and said friction material being shaped to circumferentially engage the exterior surface of the ram;

a brake operating mechanism connected to said brake arms for pivoting said brake arms between a ready position out of engagement with the ram and an actuated position in engagement with the ram;

a source of an electrical signal representing an operating condition of a hydraulic elevator car connected to the ram; and a brake controller connected between said signal source and said brake operating mechanism whereby, when said brake is installed on the hydraulic elevator system, one of said brake operating mechanism and said brake controller is responsive to a normal hydraulic pressure in a cylinder associated with the ram for maintaining said brake in the ready position and is responsive to a loss of the normal hydraulic pressure for moving said brake to the actuated position, said brake controller being responsive to said electrical signal for moving said brake to the actuated position when said electrical signal represents a predetermined operating condition of the elevator car.

12. The safety brake system according to claim 11 wherein said friction material is copper.

13. A safety brake system for retrofitting an existing hydraulic elevator having an elevator car coupled to a ram for moving the car in response to a selective application of hydraulic fluid to an associated cylinder, the safety brake system comprising:

a spacer ring adapted to be mounted on an upper end of a hydraulic elevator cylinder;

a brake having a pair of brake arms pivotally mounted on said spacer ring, each said brake arm having a friction material mounted thereon, said brake arms and said friction material being shaped to circumferentially engage the exterior surface of the ram;

a brake operating mechanism connected to said brake arms for moving said brake arms between a ready position out of engagement with the ram and an actuated position in engagement with the ram;

a sensor for generating an electrical signal representing an operating condition of a hydraulic elevator car connected to the ram; and a brake controller connected between said signal source and said brake operating mechanism whereby, when said brake safety system is installed on the hydraulic elevator system, one of said brake operating mechanism and said brake controller is responsive to a normal hydraulic pressure in the cylinder for maintaining said brake in the ready position and is responsive to a loss of the normal hydraulic pressure for moving said brake to the actuated position, said brake controller being responsive to said electrical signal for moving said brake to the actuated position when said electrical signal represents a predetermined operating condition of the elevator car.

14. A brake safety brake system according to claim 13 wherein said brake operating mechanism and said brake controller are mounted on said spacer ring.

15. A brake safety brake system according to claim 13 wherein said brake operating mechanism includes a hydraulic actuation assembly connected to said brake arms and adapted to be in fluid communication with the cylinder, whereby said hydraulic actuation assembly is responsive to a normal hydraulic pressure in the cylinder for maintaining said brake in the ready position and is responsive to a loss of the normal hydraulic pressure for moving said brake to the actuated position, and wherein said brake controller includes an electric actuation assembly connected to said hydraulic actuation assembly whereby said electric actuation assembly is responsive to said electrical signal for actuating said hydraulic actuation assembly to move said brake to the actuated position when said electrical signal represents said predetermined operating condition of the elevator car.

16. The safety brake system according to claim 13 wherein said brake controller includes an electric actuation assembly connected to said brake arms by said brake operating mechanism and being responsive to a pressure signal representing fluid pressure in the cylinder whereby said electric actuation assembly is responsive to said pressure signal representing a normal hydraulic pressure in the cylinder for maintaining said brake in the ready position and is responsive to said pressure signal representing a loss of the normal hydraulic pressure for moving said brake to the actuated position.

17. The safety brake system according to claim 16 wherein said brake operating mechanism includes an actuator adapted to be in fluid communication with the cylinder and being in fluid communication with said hydraulic actuation assembly, said brake controller being connected to said actuator for controlling said actuator to prevent fluid flow to said hydraulic actuation assembly whereby said brake is moved to the actuated position when said electrical signal represents said predetermined operating condition of the elevator car.

18. A brake safety brake system according to claim 17 wherein said actuator includes a pair of solenoid operated three-way valves connected in series, each of said valves being individually actuated by said brake controller to prevent fluid flow to said hydraulic actuation assembly.

19. A brake safety brake system according to claim 17 wherein said actuator includes a manifold being actuated by said brake controller.

20. A brake safety brake system according to claim 17 wherein said sensor is a speed sensor for generating said electrical signal representing an actual speed of the elevator car.

21. A brake safety brake system according to claim 13 wherein said brake controller includes a programmed CPU for performing an initialization program to determine if said electrical signal represents a warning condition, said CPU being responsive to said electrical signal representing a warning condition for performing at least one of moving said brake to the actuated position and generating an alarm signal.

22. A brake safety brake system according to claim 13 wherein said brake controller includes a programmed CPU for selecting and performing an up coil subroutine when said electrical signal represents an upward direction of travel for the elevator car, a down coil subroutine when said electrical signal represents a downward direction of travel for the elevator car, and a service subroutine when said electrical signal represents neither direction of travel for the elevator car, said CPU checking at least one operating condition of the elevator car for a problem during each of said subroutines and performing at least one of moving said brake to the actuated position and generating an alarm signal when a problem is detected.

23. A brake safety brake system according to claim 22 wherein said CPU performs a service mode subroutine when a predetermined problem is detected and generates a signal representing diagnostic information for display.

24. A brake safety brake system according to claim 22 wherein said CPU performs a system status subroutine when a predetermined problem is detected and generates a signal representing diagnostic information for display.

* * * * *